US006848489B2

(12) United States Patent
Lissoni

(10) Patent No.: US 6,848,489 B2
(45) Date of Patent: Feb. 1, 2005

(54) MANUAL ADHESIVE TAPE DISPENSER HAVING CUTTING BLADE PROTECTION MEANS

(75) Inventor: Adelio Lissoni, Vedano Olona (IT)

(73) Assignees: Ben Clements & Sons, Inc., South Hackensack, NJ (US); Societa'Internazionale Applicazioni Techniche S.p.A., Turate (IT)

( * ) Notice: Subject to any disclaimer, the term of this patent is extended or adjusted under 35 U.S.C. 154(b) by 0 days.

(21) Appl. No.: 10/413,326

(22) Filed: Apr. 14, 2003

(65) Prior Publication Data

US 2004/0016509 A1 Jan. 29, 2004

(30) Foreign Application Priority Data

Apr. 24, 2002 (IT) ..... MI2002A0890

(51) Int. Cl.[7] ..... B32B 31/00

(52) U.S. Cl. ..... 156/523; 156/577; 156/579; 225/19; 225/22; 225/89

(58) Field of Search ..... 156/577, 523, 156/579, 576, 486, 526, 527, 575; 225/19, 25, 56, 89, 72, 22

(56) References Cited

U.S. PATENT DOCUMENTS 5,641,377 A 6/1997 Chung et al.
5,792,310 A * 8/1998 Thompson et al. ..... 156/523
5,849,144 A 12/1998 Tang et al.

* cited by examiner

*Primary Examiner*—Chris Fiorilla
*Assistant Examiner*—Cheryl N. Hawkins
(74) *Attorney, Agent, or Firm*—Stroock & Stroock & Lavan LLP

(57) ABSTRACT

A dispenser comprises a frame that supports a roll of adhesive tape, a handle, a flexible spatula for applying the cut end of the tape, and a cutting blade. The flexible spatula forms a right-angled member having a main arm and another arm which supports the cutting blade. The right-angled member is mounted so as to be rotatable between a rest position, in which the cutting blade is pressed by a spring against a protective member, and a working position, in which the cutting blade is lifted from the protective member so that serrations thereon intersect the path of the adhesive tape. This protective member has a face, on which the blade rests, and which ends in a projecting lip, forming a frontal protection for the serrations on the blade.

6 Claims, 4 Drawing Sheets

MANUAL ADHESIVE TAPE DISPENSER HAVING CUTTING BLADE PROTECTION MEANS

FIELD OF THE INVENTION

The present invention relates to a manual adhesive tape dispenser in which a roll of adhesive tape is supported by a frame, having a handle for holding and operation, means for guiding the unrolling tape, so as to facilitate the application thereof on packing products, and means for cutting the tape once applied.

BACKGROUND OF THE INVENTION

Dispensers of this sort are well known and are used in the fields of manufacturing and packaging for all types of products. They are generally highly effective, as well as convenient and easy to use. The only disadvantage is that, if an operator grasps the dispenser incorrectly, in particular other than by the handle, it is possible that due to carelessness or hurry, the person's hand will come against the tape cutting blade, which protrudes from the frame of the dispenser in the form of sharp serrations, whereby they may be cut or otherwise injured.

This disadvantage, which has been the subject of considerable attention, has been addressed in the art, in particular in U.S. Pat. No. 5,641,377; according to the constitution described in this document, the cutting blade is movable between a rest position, in which it is withdrawn and does not project from the disperser frame, and a cutting position, in which it is caused to project towards the path of the tape. To control this movement, the flexible spatula is mounted and fixed to the frame so as to be rotatable around a pivot supported by the frame; the principal forward part thereof projects from the frame so as to serve the usual purpose thereof, while the rear part thereof, which forms a short appendix, is positioned in the vicinity of the back edge of the cutting blade. In the rest position, the rear appendix of the flexible spatula is distant from the movable blade while, when used, this is rotated so as to press against the back edge of the blade and urge this to a protruding cutting position.

Thus, with such a constitution, at the end of the operation of applying the tape to the packing product, when the dispenser is tilted as described above, the flexible spatula first comes in contact with the surface of the product and is then caused to rotate due to the force used to apply the tape, so that the posterior appendix thereof pushes the blade until this intersects the path of the tape and cuts it.

The dispenser described in the aforementioned U.S. Pat. No. 5,641,377 does not, however, solve the problem of safeguarding the operator in a fully satisfactory manner. While the blade is temporarily withdrawn with respect to the frame of the dispenser, it still presents exposed serrations, and thus, though less likely, it is still possible for the hand of a careless or hurried operator to come against the serrations on the blade, with ensuing consequences. Accordingly, an object of the present invention is to provide a manual adhesive tape dispenser having a constitution which overcomes one or more shortcomings in the prior art.

SUMMARY OF THE INVENTION

The present invention relates to a manual adhesive tape dispenser in which a roll of adhesive tape is supported by a frame, having a handle for holding and operation, means for guiding the unrolling tape, so as to facilitate the application thereof on packing products, and means for cutting the tape once applied.

More specifically, the adhesive tape dispenser support frame comprises, in general terms, a freely rotatable hub, on which the roll of adhesive tape is mounted and, sequentially downstream from this, an application roller, means for cutting the tape, and a flexible spatula which serves to press the end of the tape against the packing product. The cutting means are positioned along this path, between the take-off point on the roll and the flexible spatula, so that after applying the adhesive tape to the packing product by rolling the application roller along the horizontal surface of the product, by simply moving downward along the vertical surface of the packing product with this pressing against the body of the dispenser, the blade acts on the tape so as to cut it. Continuing this vertical descent, the spatula presses the cut end of the tape against the vertical surface of the packing product so that it fully adheres thereto.

BRIEF DESCRIPTION OF THE DRAWINGS

Other characteristics and advantages of the dispenser according to the present invention will be made apparent in the following detailed description, which sets forth a preferred embodiment thereof by way of example, taken in consideration with the accompanying drawings wherein.

DETAILED DESCRIPTION OF THE PREFERRED EMBODIMENTS

Figure 2:
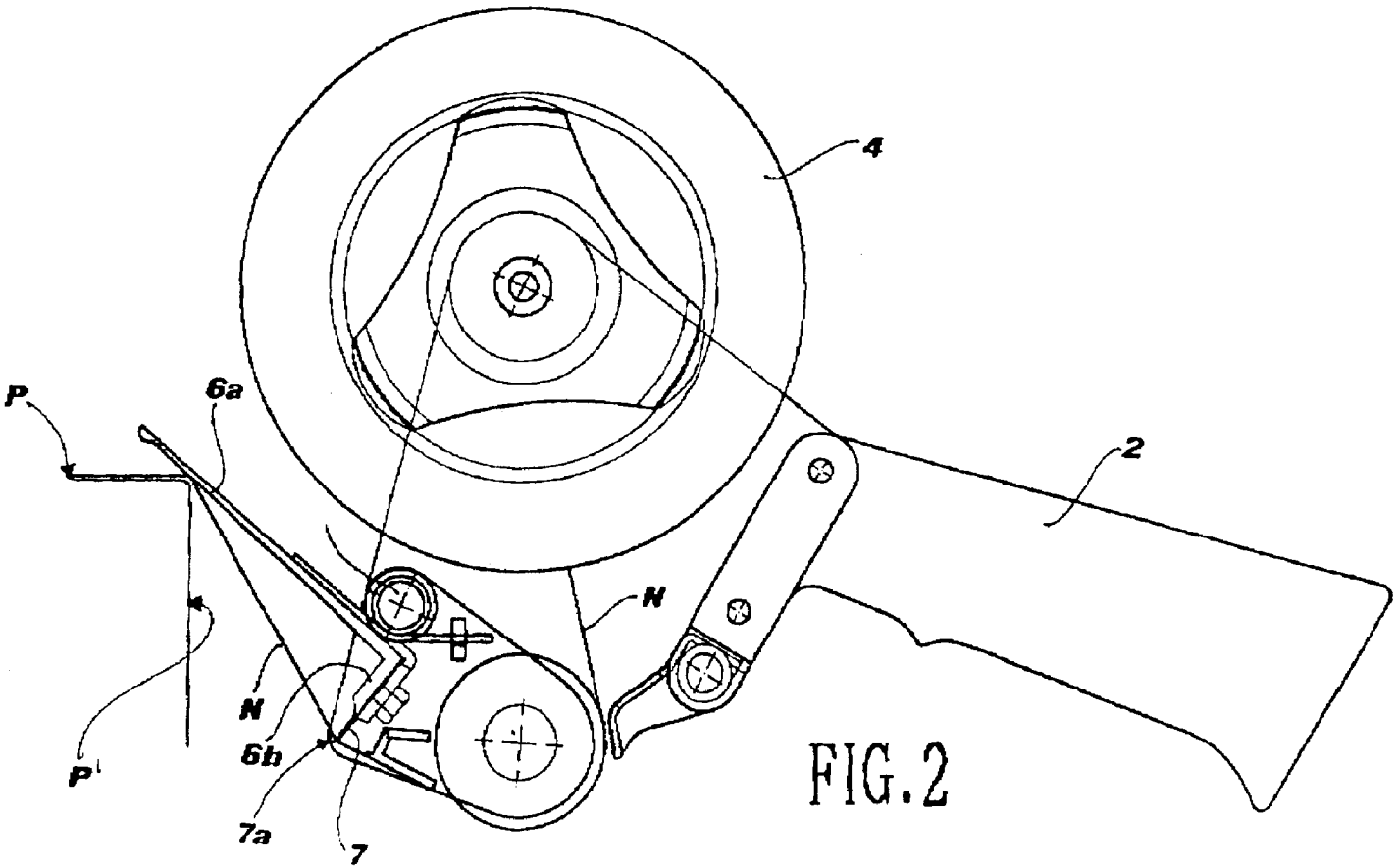
FIG. 2 is a view similar to that of FIG. 1, wherein the dispenser has gone beyond the edge of the packing product, passing from the upper horizontal surface of the product to the vertical surface thereof.

The dispenser, according to the present invention, notably comprises a support frame 1, provided with a handle 2 for grasping and operating the dispenser, and means for facilitating the application of the tape on packing products, principally comprising a freely rotatable hub 3, on which a roll of tape 4 is mounted, downstream of which are provided a roller 5 for applying the tape N (indicated by a dotted-dashed line) and a flexible spatula 6 that serves to press a cut end of the tape against a surface P of the packing product (as shown in FIG. 2).

As described above, the dispenser shown in FIG. 1 is shown in the normal position for application of the tape to a horizontal surface P. In FIG. 2, the dispenser is shown pressing against the vertical surface P' of the packing product, which is to say, in the final phase of application, in which the flexible spatula 6 presses the cut end of the tape against the surface P'.

According to the basic characteristics of the present invention, the spatula 6 forms a substantially right angle, having a long arm 6*a* which notably protrudes beyond the frame 1, and a short arm 6*b* on which a blade 7 is rigidly mounted. The right-angled spatula 6 is mounted on a cylinder 8, which is rotatably mounted on the frame 1, and around which is wrapped a coil spring 9, a first arm 9' thereof being fixed to the frame 1, and a second arm 9" thereof pressing against the spatula 6 so as to exert thereon an anticlockwise (as shown in the drawing) rotational force.

Figure 1:
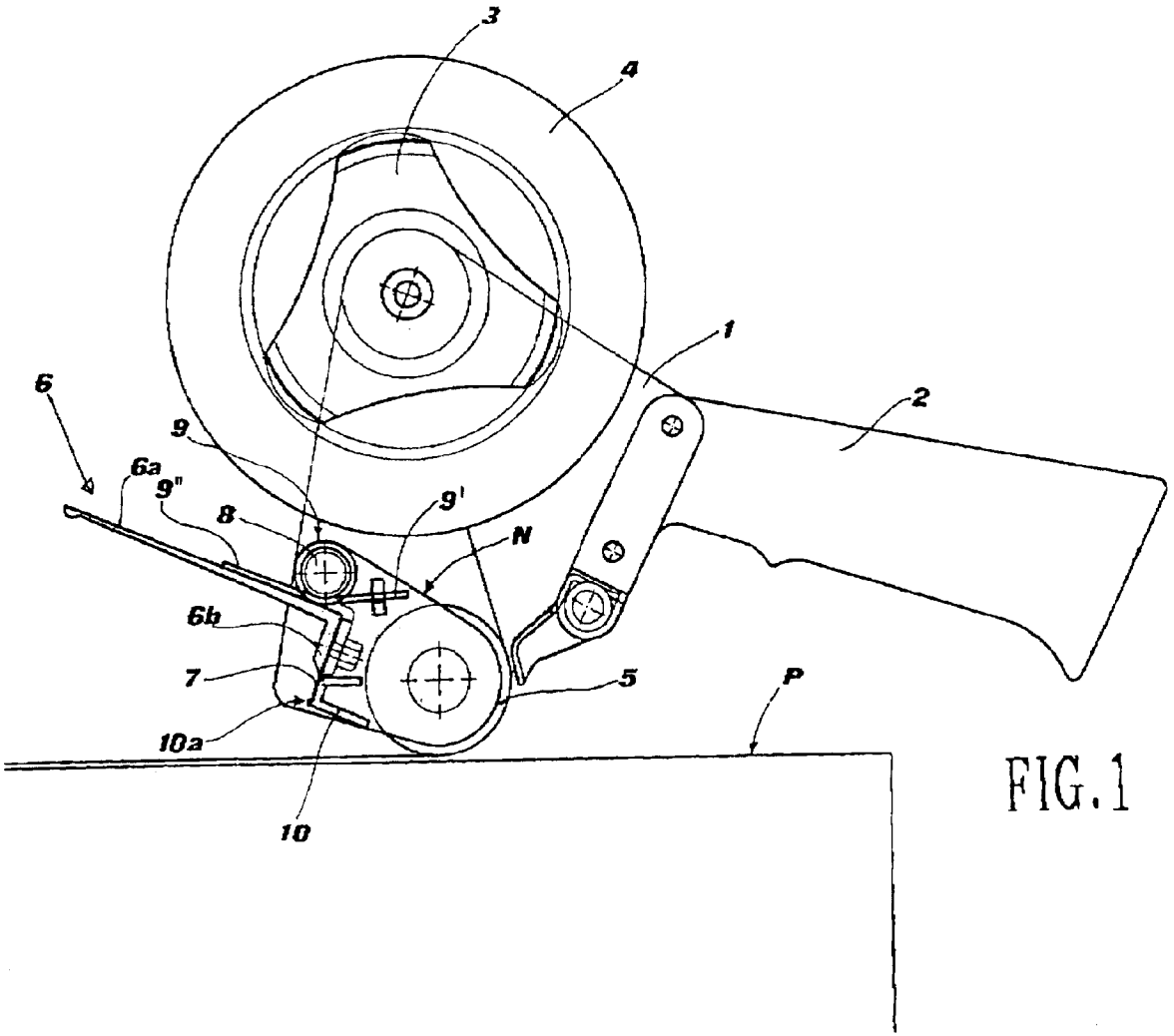
FIG. 1 is an elevated schematic view of an adhesive tape dispenser according to the present invention, in the process of applying adhesive tape to a horizontal surface of a packing product.
Figure 5:
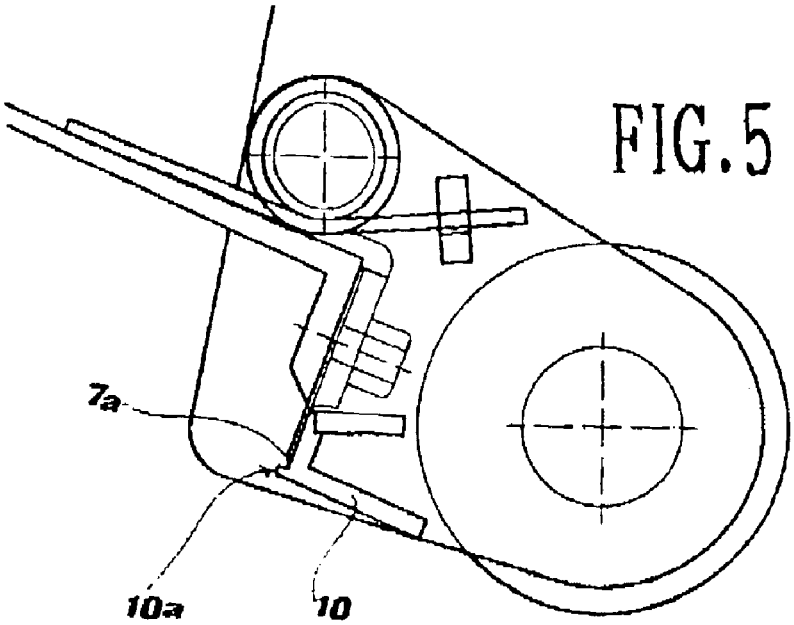

As a result of this urging, the arm 6*b* of the spatula, and together therewith, the blade 7, are normally held against a protective member 10, which is fixed to the frame 1 (as shown in FIGS. 1 and 5). This member 10 comprises a substantially planar support surface 10 and is preferably provided, at the front edge thereof, with a lip 10*a* that projects upwards, as shown in the enlarged detail in FIG. 5.

Thus, when operated as shown in FIG. 1, and more importantly, when at rest, the blade 7 lies against the member 10 so that a plurality of serrations 7*a* on the blade 7 are protected, not only because they lie against the member 10, but also by way of the lip 10*a* which covers these serrations 7*a*.

Figure 3:
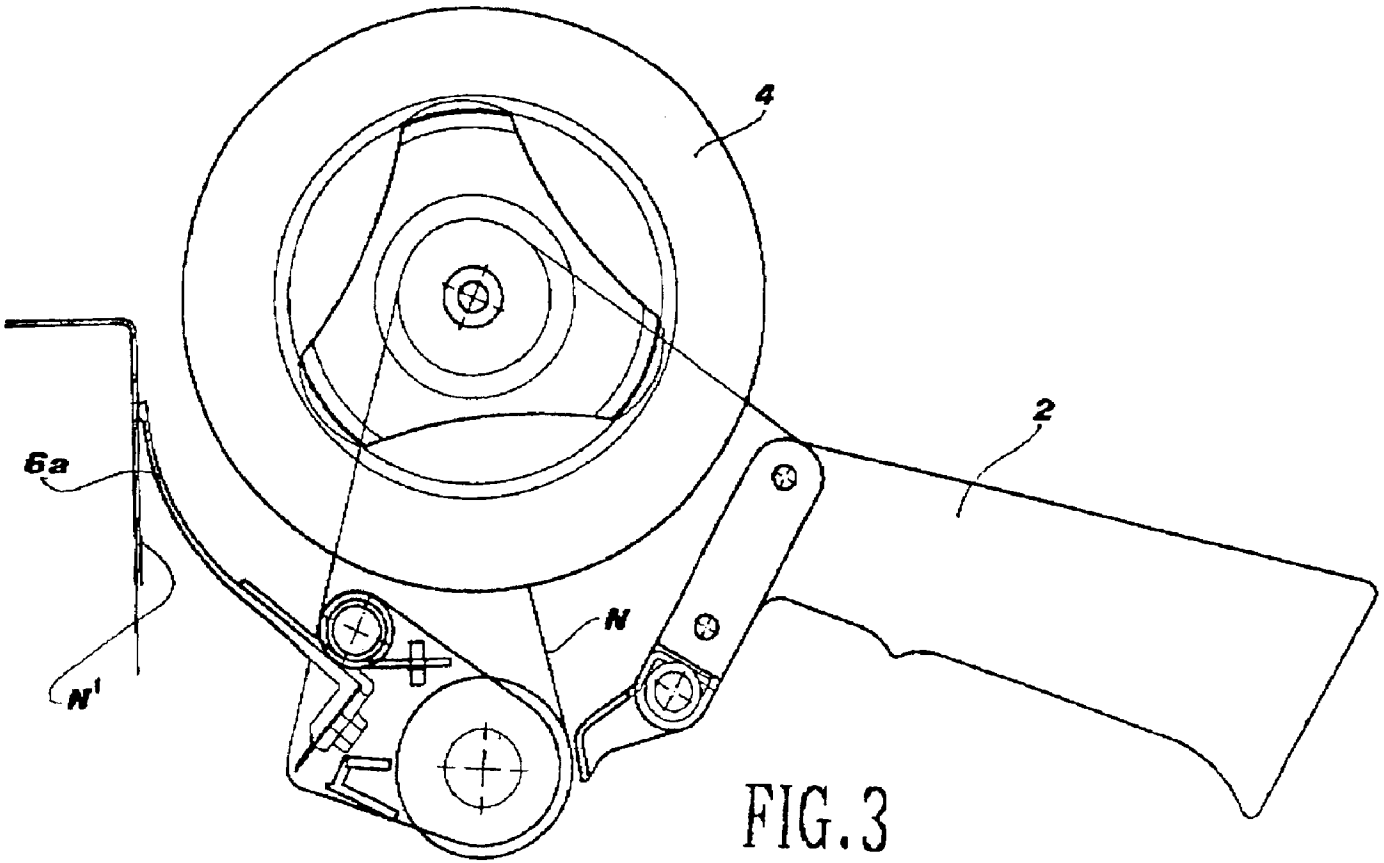
FIG. 3 is again a view similar to that of FIG. 1, but in a position wherein the cut end of the adhesive tape is applied on the vertical surface of the packing product.
Figure 4:
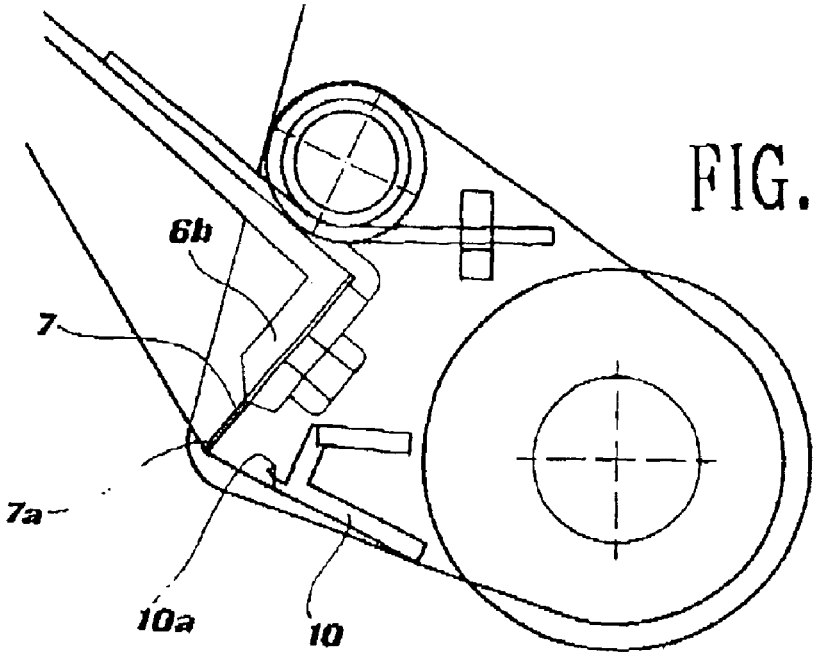
FIG. 4 and FIG. 5 are enlarged views of details showing the cutting blade and a protective member therefor in working and rest positions, respectively.

When operated, which is to say, when the end of the adhesive tape is applied, as shown sequentially in FIGS. 2 and 3, the arm 6*a* of the spatula 6 first presses against the corner between the horizontal surface P and the vertical surface P' of the packing product; the pressure against this corner results in a clockwise rotation (as shown in FIG. 2) against the force of the spring 9, so that the blade 7 is lifted from its rest position against the member 10, and the serrations 7*a* thereof intersect the path of the tape N, whereby the tape is cut (see FIGS. 2 and 4).

In the final position, as shown in FIG. 3, the arm 6*a* of the spatula 6 is flexed by the pressure against the packing product, so as to ensure reliable application of the end N' of the adhesive tape on the vertical surface P' of the packing product.

As soon as the operator moves the dispenser away from the surface P', after completing the application of the tape N, the spatula 6 springs back into the rest position as the result of the force of the spring 9, bringing the blade 7 against the member 10 so that this is completely protected.

The present invention is not limited to the specific embodiments described above, which are intended solely as examples. It will be understood by those skilled in the art that various changes and modifications are possible without departing from the spirit and scope of the invention, which is to be determined by the following claims.

What is claimed is:

1. A manual adhesive tape dispenser comprising a frame that supports a roll of adhesive tape, provided with a handle for grasping and operating the dispenser, and means for facilitating the application of the tape on packing products and cutting the tape when the application is complete, these means comprising at least a flexible spatula that serves to apply a cut end of the tape, and a cutting blade, wherein said flexible spatula forms a two-armed member, having a main arm and another arm which supports and is united with said cutting blade, and wherein said two-armed member is mounted so as to be rotatable between a rest position, in which said cutting blade lies against a protective member that is fixed on the frame of the dispenser, and a working position, in which said cutting blade is lifted from said protective member so that serrations thereon intersect the path of the adhesive tape.

2. The manual adhesive tape dispenser of claim 1, wherein said two-armed member forms a right-angled member.

3. The manual adhesive tape dispenser of claim 2, wherein said right-angled member of the flexible spatula is mounted so as to be rotatable between said rest position and said working position, and wherein spring means are associated therewith, which urge said right-angled member to the rest position.

4. The manual adhesive tape dispenser of claim 2, wherein said right-angled member can be rotated from said rest position to said working position by the force exerted by said flexible spatula against the faces of the packing product in the final phase of application of the adhesive tape.

5. The manual adhesive tape dispenser of claim 1, wherein said protective member has a planar surface, against which said blade lies, and which extends beyond the cutting points of a plurality of serrations on said blade.

6. The manual adhesive tape dispenser of claim 1, wherein said protective member has a planar surface against which said blade lies, and which terminates in a protruding lip providing frontal protection for a plurality of cutting serrations on said blade.

* * * * *